US011298798B2

(12) United States Patent
Wang et al.

(10) Patent No.: US 11,298,798 B2
(45) Date of Patent: Apr. 12, 2022

(54) POLISHING DELIVERY APPARATUS

(71) Applicant: NANYA TECHNOLOGY CORPORATION, New Taipei (TW)

(72) Inventors: Jiun-Bo Wang, New Taipei (TW); Chia-Hung Su, Taipei (TW); Yuan-Chi Hsieh, New Taipei (TW); Chih-Yuan Chen, New Taipei (TW); Ming-Fa Tsai, Taoyuan (TW); Chih-Wang Hsu, New Taipei (TW)

(73) Assignee: NANYA TECHNOLOGY CORPORATION, New Taipei (TW)

( * ) Notice: Subject to any disclaimer, the term of this patent is extended or adjusted under 35 U.S.C. 154(b) by 299 days.

(21) Appl. No.: 16/792,155

(22) Filed: Feb. 14, 2020

(65) Prior Publication Data

US 2021/0252669 A1 Aug. 19, 2021

(51) Int. Cl.
*B24B 57/02* (2006.01)

(52) U.S. Cl.
CPC ..... *B24B 57/02* (2013.01)

(58) Field of Classification Search
CPC ..... B24B 57/02
USPC ..... 451/446, 28, 67, 283, 287, 288
See application file for complete search history.

(56) References Cited

U.S. PATENT DOCUMENTS

| | | | | |
|---|---|---|---|---|
| 6,053,801 | A | 4/2000 | Pinson et al. | |
| 7,052,374 | B1 * | 5/2006 | Lu | B24B 37/04 451/60 |
| 10,350,728 | B2 * | 7/2019 | Diao | B24B 53/017 |
| 2010/0112917 | A1 * | 5/2010 | Leighton | B24B 57/02 451/446 |

FOREIGN PATENT DOCUMENTS

| | | | |
|---|---|---|---|
| JP | 2007168039 | A | 7/2007 |
| JP | 2014087908 | A | 5/2014 |
| TW | I273650 | B | 2/2007 |
| TW | I466757 | B | 1/2015 |

* cited by examiner

*Primary Examiner* — Joseph J Hail
*Assistant Examiner* — Shantese L McDonald
(74) *Attorney, Agent, or Firm* — CKC & Partners Co., LLC

(57) ABSTRACT

A polishing delivery apparatus, configured to provide slurry and rinse agent to a polishing pad, includes a delivery arm, at least one first nozzle, and at least one second nozzle. The delivery arm is rotatably connected to the polishing pad and has an arc-shaped top surface facing away from the polishing pad, a bottom surface facing away from the arc-shaped top surface, and a recess indenting from the bottom surface. The first nozzle is mounted on the bottom surface of the delivery arm and has a first nozzle head facing toward the polishing pad. The second nozzle is mounted in the recess of the delivery arm and has three second nozzle heads, in which one of the three second nozzle heads faces toward the polishing pad, and the other two of the three second nozzle heads face toward sidewalls of the recess.

20 Claims, 7 Drawing Sheets

POLISHING DELIVERY APPARATUS

BACKGROUND

Field of Invention

The present disclosure relates to a polishing delivery apparatus.

Description of Related Art

Semiconductor devices are used in a variety of electronic applications, such as personal computers, cell phones, digital cameras, and other electronic equipment. The semiconductor industry continues to improve the integration density of various electronic components (e.g., transistors, diodes, resistors, capacitors, etc.) by continual reductions in minimum feature size, which allows more components to be integrated into a given area.

During the manufacturing of the semiconductor devices, various processing steps are used to fabricate integrated circuits on a semiconductor wafer. Generally, the processing steps include a chemical mechanical polishing (CMP) process for planarization of semiconductor wafers, thereby helping to provide more precisely structured device features on the integrated circuits. The CMP process is a planarization process that combines chemical removal with mechanical polishing. Since the CMP process is one of the most important processes for forming integrated circuits, it is desired to provide mechanisms to maintain the reliability and the efficiency of the CMP process.

SUMMARY

The present disclosure relates in general to a polishing delivery apparatus.

According to an embodiment of the present disclosure, a polishing delivery apparatus is configured to provide slurry and rinse agent to a polishing pad. The polishing delivery apparatus includes a delivery arm, at least one first nozzle, and at least one second nozzle. The delivery arm has an arc-shaped top surface, a bottom surface, and a recess. The arc-shaped top surface faces away from the polishing pad, the bottom surface faces away from the arc-shaped top surface, and the recess indents from the bottom surface. The first nozzle is mounted on the bottom surface of the delivery arm and has a first nozzle head facing toward the polishing pad. The second nozzle is mounted in the recess of the delivery arm and has three second nozzle heads, in which one of the three second nozzle heads faces toward the polishing pad, and the other two of the three second nozzle heads face toward sidewalls of the recess.

In an embodiment of the present disclosure, an angle between the second nozzle head facing toward the polishing pad and an extending plane of the polishing pad is in a range from 85° to 95°.

In an embodiment of the present disclosure, the second nozzle heads facing toward the sidewalls of the recess are tightly in contact with a top surface of the recess.

In an embodiment of the present disclosure, the second nozzle heads facing toward the sidewalls of the recess are opposite to each other.

In an embodiment of the present disclosure, a curvature radius of the arc-shaped top surface is R, a width of the delivery arm is W, and R is in a range from W/3 to 2 W/3.

In an embodiment of the present disclosure, the polishing delivery apparatus further includes at least one slurry delivery line and a rinse agent delivery line. The slurry delivery line is connected to the first nozzle, and the rinse agent delivery line is connected to the second nozzle.

In an embodiment of the present disclosure, the slurry delivery line and the first nozzle are integrally formed as a single piece without an interface therebetween.

In an embodiment of the present disclosure, the slurry delivery line has a main portion and a branched portion, the main portion extends in an extending direction of the delivery arm, and the branched portion is connected to the first nozzle.

In an embodiment of the present disclosure, the rinse agent delivery line has a main portion and at least one branched portion, the main portion extends in an extending direction of the delivery arm, and the branched portion is connected to the second nozzle.

In an embodiment of the present disclosure, the polishing delivery apparatus further includes a plurality of the slurry delivery lines, and the main portions of the slurry delivery lines are evenly distributed at two sides of the branched portion of the rinse agent delivery line.

In an embodiment of the present disclosure, the polishing delivery apparatus further includes at least one third nozzle mounted on an edge of the delivery arm. The third nozzle has a third nozzle head, and an angle between the third nozzle head and an extending plane of the polishing pad is in a range from 125° to 135°.

In an embodiment of the present disclosure, the polishing delivery apparatus further includes at least two rinse agent delivery lines respectively connected to the first nozzle and the third nozzle. The rinse agent delivery lines are coupled to each other.

In an embodiment of the present disclosure, the polishing delivery apparatus further includes a fourth nozzle mounted on a front end of the delivery arm. The fourth nozzle has a fourth nozzle head, and an angle between the fourth nozzle head and an extending plane of the polishing pad is in a range from 125° to 135°.

In an embodiment of the present disclosure, the fourth nozzle is mounted higher than the first nozzle and the second nozzle.

In an embodiment of the present disclosure, the delivery arm has a convex portion and a body portion, and the convex portion is detachably fixed to the body portion of the delivery arm.

In an embodiment of the present disclosure, the first nozzle is mounted on a bottom surface of the convex portion of the delivery arm.

In an embodiment of the present disclosure, the polishing delivery apparatus further includes at least one fixing component fixing the convex portion to the body portion of the delivery arm.

In an embodiment of the present disclosure, the polishing delivery apparatus further includes at least one capping component tightly covering the fixing component.

In an embodiment of the present disclosure, the polishing delivery apparatus further includes a plurality of the second nozzles, and the second nozzles are arranged in an extending direction of the delivery arm.

In an embodiment of the present disclosure, the arc-shaped top surface of the delivery arm is made of a material comprising Teflon.

In the aforementioned embodiments of the present disclosure, since the delivery arm has the arc-shaped top surface facing away from the polishing pad, the slurry splashed onto the arc-shaped top surface of the delivery arm has a higher chance to drop back to the polishing pad during the chemical mechanical polishing (CMP) process. Therefore, the slurry is less likely to be deteriorated into dry residues which may subsequently drop back to the polishing pad to cause defect to the wafer. Furthermore, the rinse agent sprayed from the second nozzle heads facing toward the sidewalls of the recess can wash down the slurry splashed into the recess during the CMP process, thus preventing the slurry from being deteriorated into dry residues in the recess.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
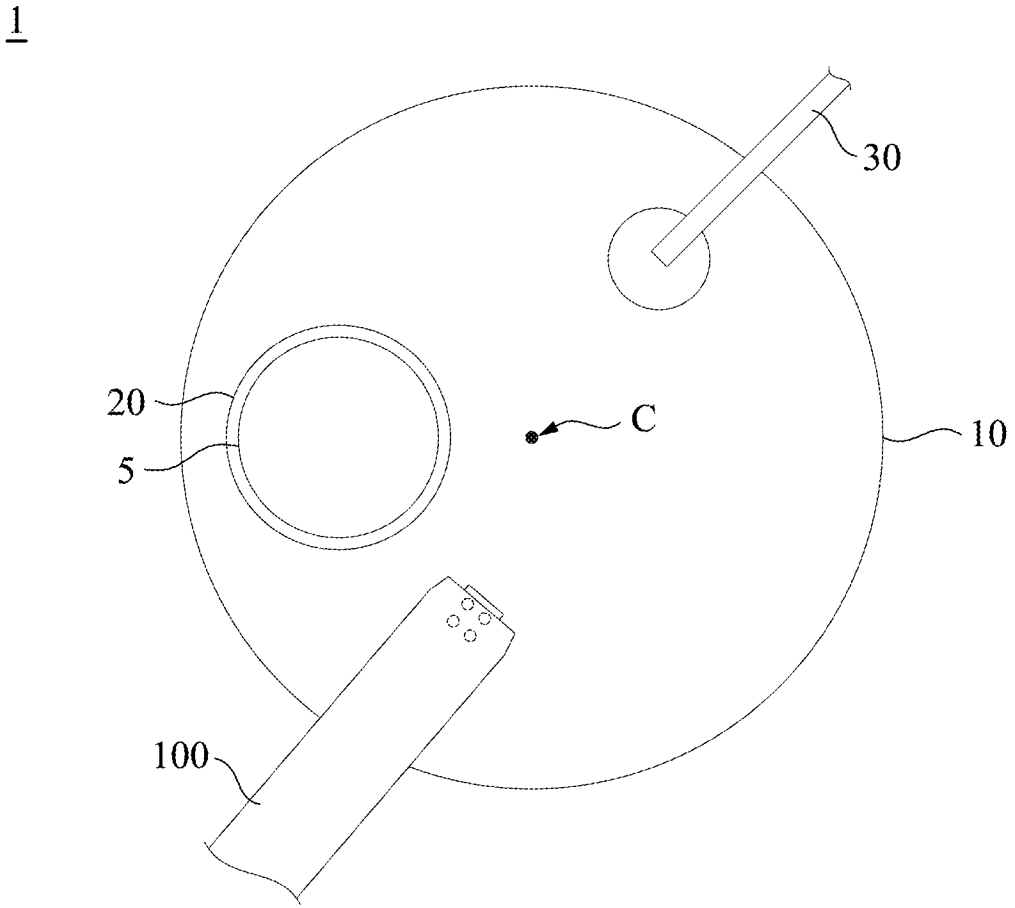
FIG. 1 is a schematic top view of a chemical mechanical polishing (CMP) system according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic top view of a chemical mechanical polishing (CMP) system 1 according to an embodiment of the present disclosure. The chemical mechanical polishing system 1 includes a polishing pad 10, a wafer holder 20, a conditioning assembly 30, and a polishing delivery apparatus 100. The polishing pad 10 may rotate about a rotation axis C during the CMP process. The wafer holder 20 may be placed on the polishing pad 10 and configured to hold a wafer 5. The conditioning assembly 30 is configured for the conditioning of the polishing pad 10. The polishing delivery apparatus 100 is rotatably connected to the polishing pad 10 and configured to provide slurry and rinse agent to the polishing pad 10.

Figure 2:
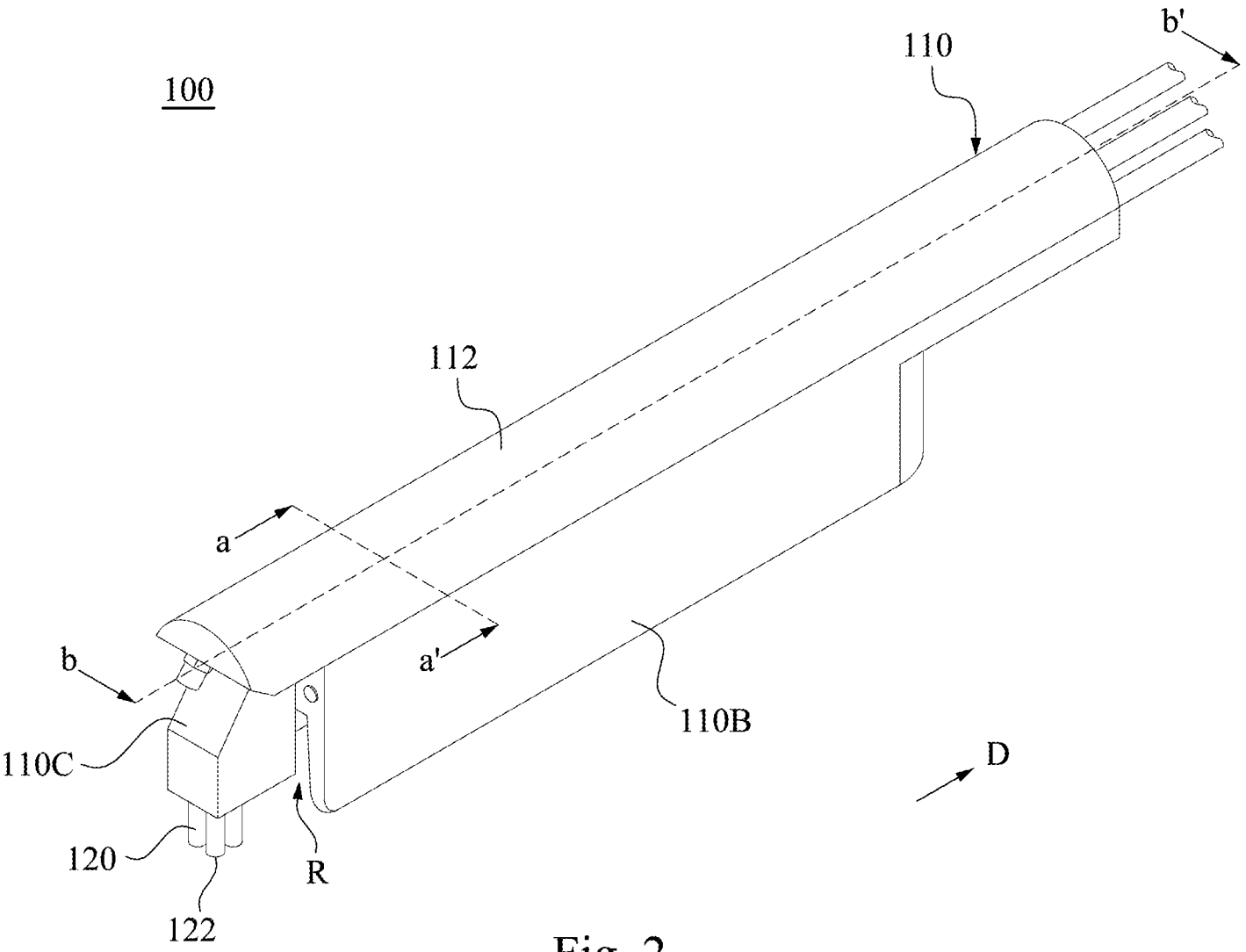
FIG. 2 is a schematic view of the polishing delivery apparatus illustrated in FIG. 1.
Figure 3:
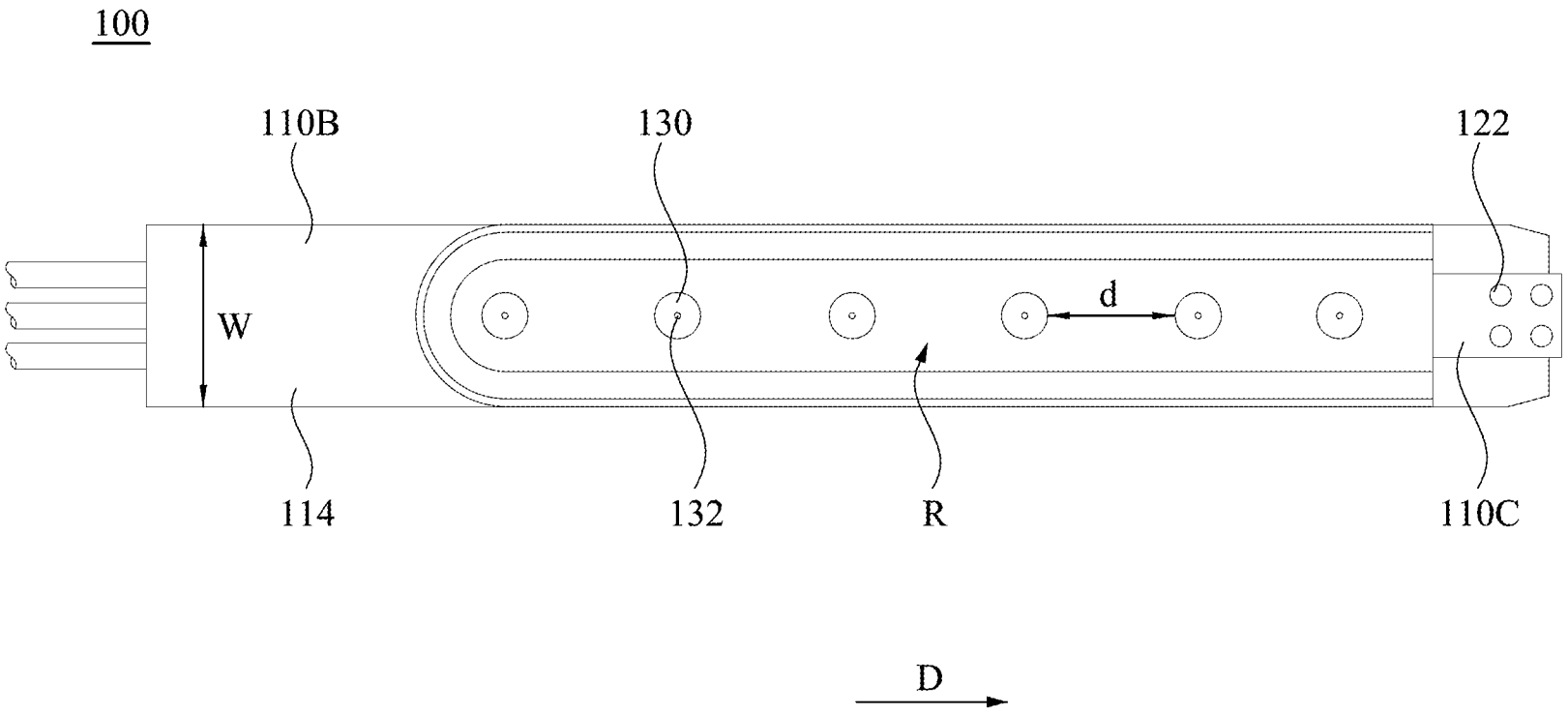
FIG. 3 is a bottom view of the polishing delivery apparatus illustrated in FIG. 2.

FIG. 2 is a schematic view of the polishing delivery apparatus 100 illustrated in FIG. 1. FIG. 3 is a bottom view of the polishing delivery apparatus 100 illustrated in FIG. 2. Reference is made to FIG. 1 to FIG. 3. The polishing delivery apparatus 100 includes a delivery arm 110, at least one first nozzle 120, and at least one second nozzle 130. The delivery arm 110 has an arc-shaped top surface 112, a bottom surface 114, and a recess R. The arc-shaped top surface 112 of the delivery arm 110 faces away from the polishing pad 10. For example, the arc-shaped top surface 112 may be in an upside-down "U" shape with respect to the polishing pad 10. The bottom surface 114 faces away from the arc-shaped top surface 112 of the delivery arm 110. Stated differently, the bottom surface 114 of the delivery arm 110 faces toward the polishing pad 10. In addition, the recess R indents from the bottom surface 114 of the delivery arm 110.

When the chemical mechanical polishing process is performed, the slurry may be splashed onto the delivery arm 110. Since the delivery arm 110 has the arc-shaped top surface 112 facing away from the polishing pad 10, the slurry splashed onto the delivery arm 110 has a higher chance to drop back to the polishing pad 10 during the CMP process. In other words, the slurry is less likely to be tightly attached to the delivery arm 110 and deteriorated into dry residues which may subsequently drop back to the polishing pad 10 to cause defect to the wafer 5. In some embodiments, the arc-shaped top surface 112 of the delivery arm 110 is made of a material comprising Teflon, which is rather smooth, to prevent the slurry from being tightly attached to the delivery arm 110.

In some embodiments, a curvature radius R1 (see FIG. 4 in advanced) of the arc-shaped top surface 112 is adjusted, such that the slurry splashed onto the arc-shaped top surface 112 of the delivery arm 110 has a higher chance to drop back to the polishing pad 10. In some embodiments, the curvature radius R1 (see FIG. 4) of the arc-shaped top surface 112 is in a range from W/3 to 2 W/3, in which W is a width of the delivery arm 110. For example, the curvature radius R1 of the arc-shaped top surface 112 may be W/2, in which W is the width of the delivery arm 110.

In some embodiments, the delivery arm 110 has a body portion 1108 and a convex portion 110C. The convex portion 110C is detachably fixed to the body portion 1108 of the delivery arm 110 from a front side. The attachment and detachment of the convex portion 110C to the body portion 1108 are exploited to assemble and disassemble the components of the polishing delivery apparatus 100 disposed in the delivery arm 110, which will be described later in the following descriptions.

In some embodiments, the first nozzle 120 is mounted on the bottom surface 114 of the delivery arm 110. For example, the first nozzle 120 may be mounted on a bottom surface of the convex portion 110C of the delivery arm 110. In some embodiments, the first nozzle 120 is configured to provide the slurry to the polishing pad 10 during the CMP process. In other embodiments, the first nozzle 120 is configured to sequentially provide the slurry and the rinse agent to the polishing pad 10 during the CMP process. The first nozzle 120 has a first nozzle head 122 facing toward the polishing pad 10. In some embodiments, an angle θ1 (see FIG. 5) between the first nozzle head 122 and an extending plane of the polishing pad 10 is in a range from 85° to 95°. For example, the angle θ1 (see FIG. 5) between the first nozzle head 122 and the extending plane of the polishing pad 10 may be 90°.

In some embodiments, the second nozzle 130 is mounted in the recess R of the delivery arm 110 and configured to provide the rinse agent during the CMP process. For example, the second nozzle 130 may provide the rinse agent at least to the polishing pad 10. In some embodiments, the polishing delivery apparatus 100 includes a plurality of the second nozzles 130, and the second nozzles 130 are arranged in the recess R along an extending direction D of the delivery arm 110. In some embodiments, distances d between the second nozzles 130 are identical.

Figure 4:
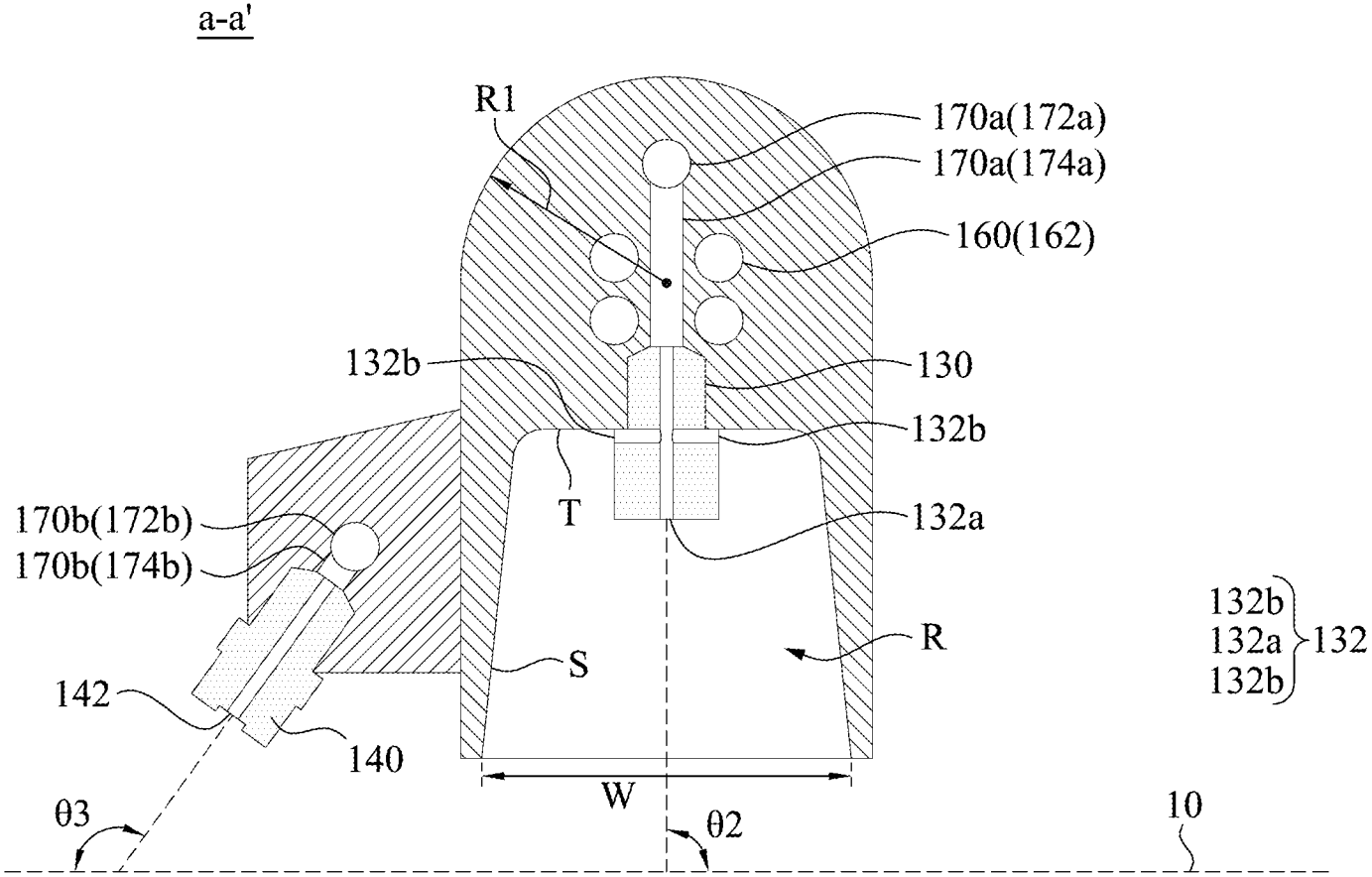
FIG. 4 is a cross-sectional view of the polishing delivery apparatus along line a-a' illustrated in FIG. 2.

FIG. 4 is a cross-sectional view of the polishing delivery apparatus 100 along line a-a' illustrated in FIG. 2. Reference is made to FIG. 4. The second nozzle 130 is mounted into the top surface T of the recess R. In some embodiments, the second nozzle 130 has three second nozzle heads 132, one of the three second nozzle heads 132 faces toward the polishing pad 10 and is referred to as the "second nozzle head 132*a*", and the other two of the three second nozzle heads 132 face toward sidewalls S of the recess R and are each referred to as the "second nozzle head 132*b*". The second nozzle head 132*a* is configured to provide the rinse agent to the polishing pad 10 for the CMP process. In some embodiments, an angle θ2 between the second nozzle head 132*a* and the extending plane of the polishing pad 10 is in a range from 85° to 95°. For example, the angle θ2 between the second nozzle head 132*a* and the extending plane of the polishing pad 10 may be 90°.

In some embodiments, each of the second nozzle head 132*b* is configured to provide the rinse agent to the sidewalls S of the recess R for preventing attachment of the slurry to the recess R. For example, the rinse agent sprayed toward the sidewalls S of the recess R may wash down the slurry splashed into the recess R during the CMP process to further prevent the slurry attached to the recess R from being deteriorated into dry residues which may fall down onto the wafer 5 and cause defect. In some embodiments, the second nozzle heads 132*b* are tightly in contact with the top surface T of the recess R, such that the rinse agent sprayed from the second nozzle heads 132*b* is able to wash down the slurry attached to the top surface T of the recess R. Stated differently, the rinse agent is able to flow along the top surface T and the sidewalls S of the recess R to wash down the slurry thoroughly. In some embodiments, the two second nozzle heads 132*b* are opposite to each other, that is, the two second nozzle heads 132*b* spray the rinse agent toward two opposite directions.

Figure 5:
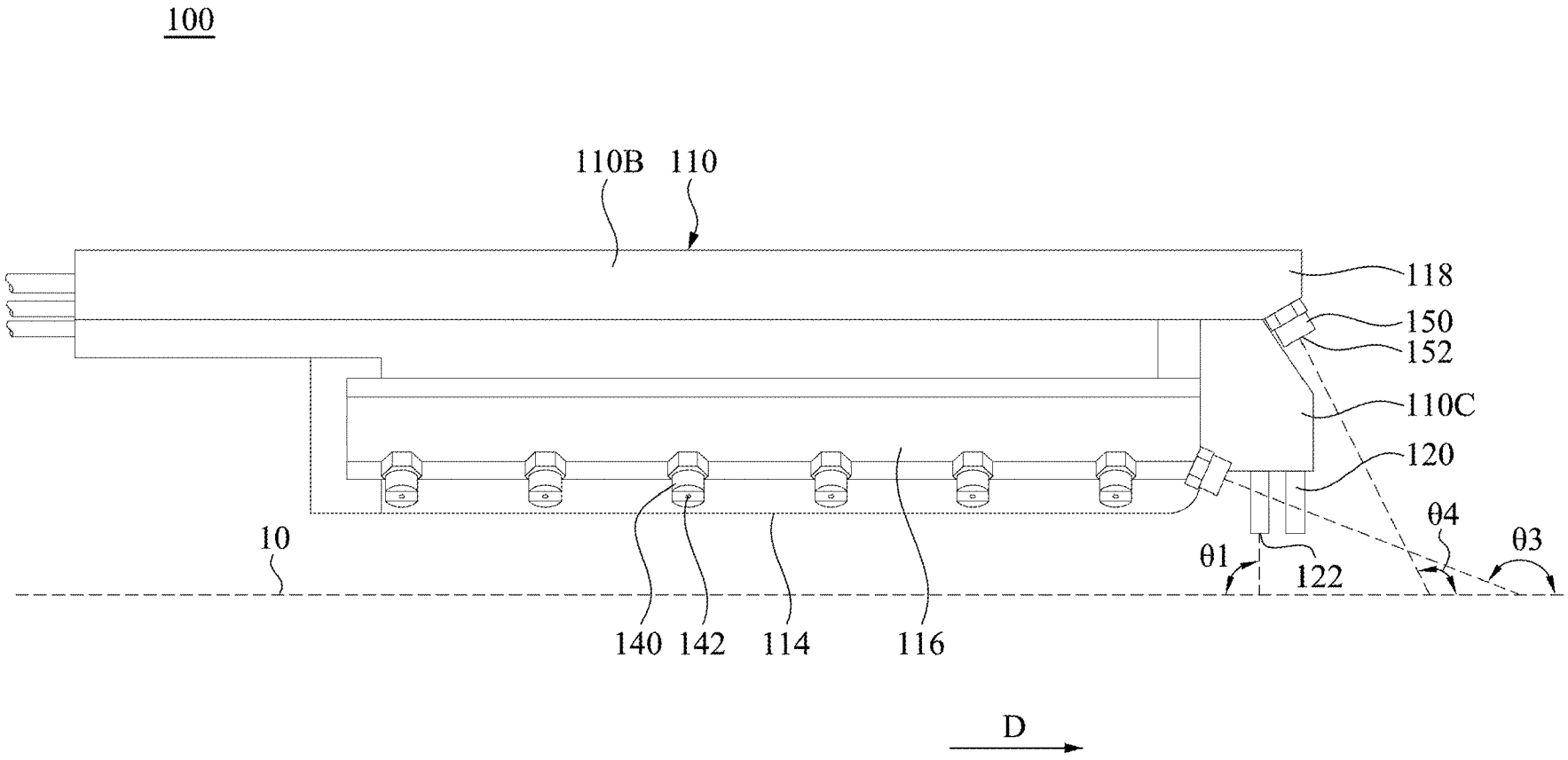
FIG. 5 is a side view of the polishing delivery apparatus illustrated in FIG. 2.

FIG. 5 is a side view of the polishing delivery apparatus 100 illustrated in FIG. 2. Reference is made to FIG. 5. The polishing delivery apparatus 100 further includes at least one third nozzle 140 mounted on an edge of the delivery arm 110 and configured to provide the rinse agent to the polishing pad 10 during the CMP process. For example, the third nozzle 140 may be mounted on the edge between a sidewall 116 and the bottom surface 114 of the delivery arm 110 to provide the rinse agent. In some embodiments, the third nozzle 140 has a third nozzle head 142 from which the rinse agent is sprayed, and an angle θ3 between the third nozzle head 142 and the extending plane of the polishing pad 10 is in a range from 125° to 135°, such that the rinse agent sprayed from the third nozzle head 142 is able to reach distal ends of the polishing pad 10. In some embodiments, a number of the third nozzle 140 is plural, and the third nozzles 140 are arranged on one edge of the delivery arm 110 in an extending direction D of the delivery arm 110.

In some embodiments, the polishing delivery apparatus 100 further includes at least one fourth nozzle 150 mounted on a front end 118 of the delivery arm 110 and configured to provide the rinse agent to the polishing pad 10 during the CMP process. For example, the fourth nozzle 150 may be mounted on the front end 118 above the convex portion 110C of the delivery arm 110 to provide the rinse agent. In some embodiments, the fourth nozzle 150 has a fourth nozzle head 152 from which the rinse agent is sprayed, and an angle θ4 between the fourth nozzle head 154 and the and the extending plane of the polishing pad 10 is in a range from 125° to 135, such that the rinse agent sprayed from the third nozzle head 142 is able to reach the distal ends of the polishing pad 10.

In some embodiments, the first nozzle 120, the second nozzle 130, the third nozzle 140, and the fourth nozzle 150 are mounted at different heights, such that different sections of the polishing pad 10 can be provided with the rinse agent. For example, the fourth nozzle 150 may be mounted higher than the first nozzle 120, the second nozzle 130, and the third nozzle 140. For another example, the third nozzle 140 and the fourth nozzle 150 may be mounted higher than the first nozzle 120 and the second nozzle 130. Since the first nozzle 120, the second nozzle 130, the third nozzle 140, and the fourth nozzle 150 are designed to be mounted at different heights and angles, the CMP process is ensured to be fully and well achieved. Furthermore, the third nozzle 140 and the fourth nozzle 150 may be mounted on the delivery arm 110 through various fixing components (e.g., screws, nut, etc.) which is made of a material including polyether ether ketone (PEEK). Such a material can prevent the fixing components from getting rusty, thus enhancing the structural strength of the polishing delivery apparatus 100.

Figure 6:
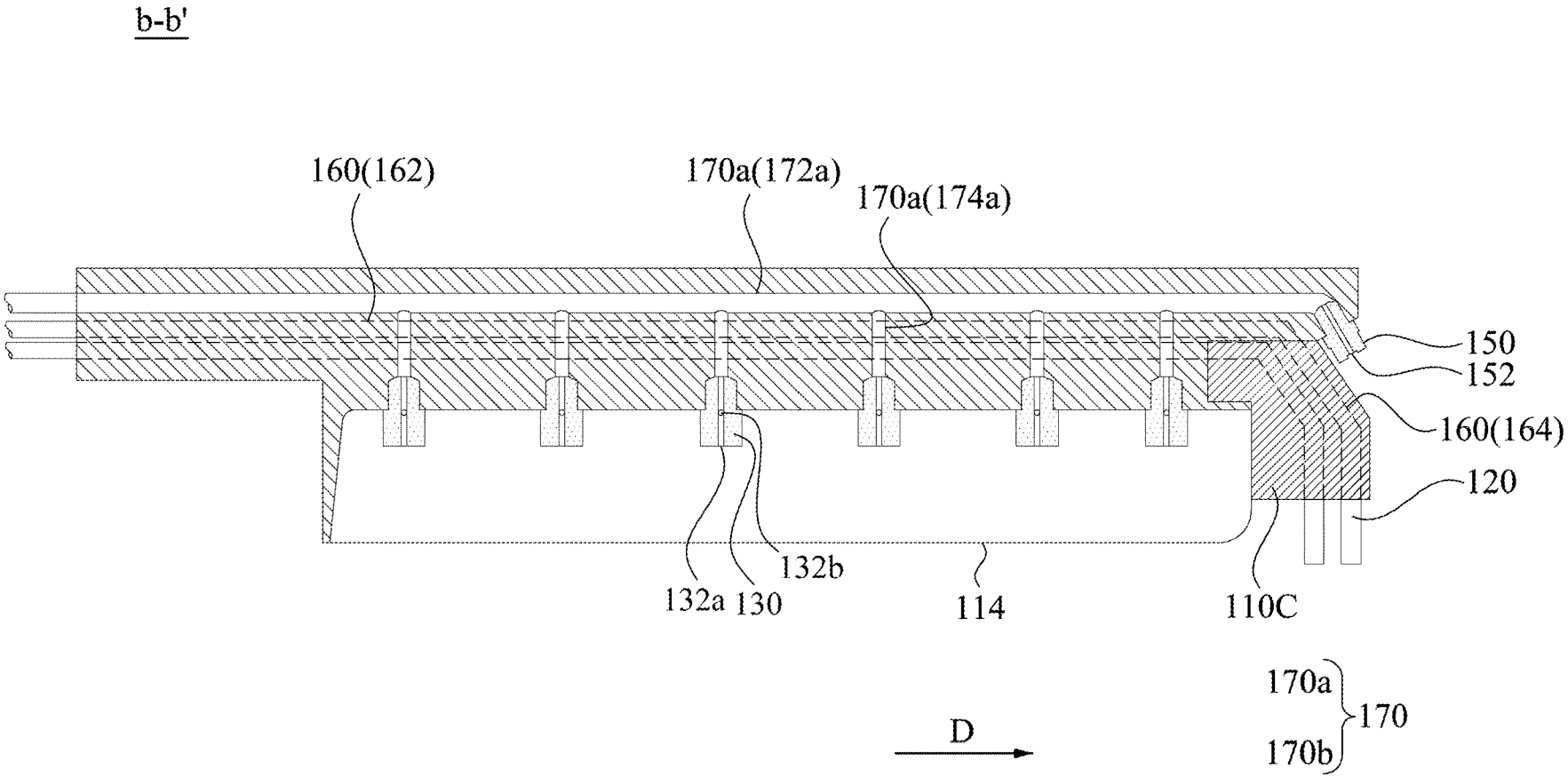
FIG. 6 is a cross-sectional view of the polishing delivery apparatus along line b-b' illustrated in FIG. 2.

FIG. 6 is a cross-sectional view of the polishing delivery apparatus 100 along line b-b' illustrated in FIG. 2. Reference is made to FIG. 4 and FIG. 6. The polishing delivery apparatus 100 further includes at least one slurry delivery line 160 connected to the first nozzle 120. In some embodiments, the slurry delivery line 160 has a main portion 162 and a branched portion 164, the main portion 162 extends in the extending direction D of the delivery arm 110, and the branched portion 164 is connected to the first nozzle 120. In some embodiments, the slurry delivery line 160 is coupled to a slurry source to transport the slurry to the first nozzle 120. In other embodiments, the slurry delivery line 160 is coupled to a slurry source and a rinse agent source to sequentially transport the slurry and the rinse agent to the first nozzle 120. In addition, a number of the slurry delivery line 160 may be adjusted according to a number of the first nozzle 120. For example, the number of the slurry delivery line 160 is adjusted to be identical to the number of the first nozzle 120, in which each of the slurry delivery lines 160 is connected to one of the first nozzles 120.

In some embodiments, the slurry delivery line 160 and the first nozzle 120 are integrally formed as a single piece without an interface therebetween, such that no interface is provided for the slurry to be accumulated. Stated differently, the slurry delivery line 160 and the first nozzle 120 may together form a tube penetrating through the bottom surface 114 of the delivery arm 110 (e.g., the bottom surface of the convex portion 110C of the delivery arm 110).

In some embodiments, the polishing delivery apparatus 100 further includes at least two rinse agent delivery lines 170. One of the rinse agent delivery lines 170 is connected to the second nozzle 130 and the fourth nozzle 150 and is referred to as the "rinse agent delivery line 170*a*", and the other of the rinse agent delivery lines 170 is connected to the third nozzles 140 and is referred to as the "rinse agent delivery line 170*b*". The rinse agent delivery line 170*a* has a main portion 172*a* and at least one branched portion 174*a*, the main portion 172*a* extends in the extending direction D of the delivery arm 110 and is connected to the fourth nozzle 150, and the branched portion 174*a* is connected to the second nozzle 130. In addition, the rinse agent delivery line 170*b* also has a main portion 172*b* and at least one branched portion 174*b*, the main portion 172*b* extends in the extending direction D of the delivery arm 110, and the main portion 172*b* and the branched portion 174*b* may each be connected to one of the third nozzles 140. In some embodiments, the rinse agent delivery line 170*a* and 170*b* are coupled to each other and further coupled to a rinse agent source to transport the rinse agent to the second nozzle 130, the third nozzle 140, and the fourth nozzle 150.

In some embodiments, when a number of the slurry delivery line 160 is plural, the main portions 162 of the slurry delivery lines 160 are evenly distributed at two sides of the branched portion 174*a* of the rinse agent delivery line 170*a*. In some embodiments, the main portions 162 of the slurry delivery lines 160 are symmetrically distributed at two sides of the branched portion 174*a* of the rinse agent delivery line 170*a*. As such, the alignment of the slurry delivery line 160 and the rinse agent delivery line 170*a* can be easily achieved.

Figure 7:
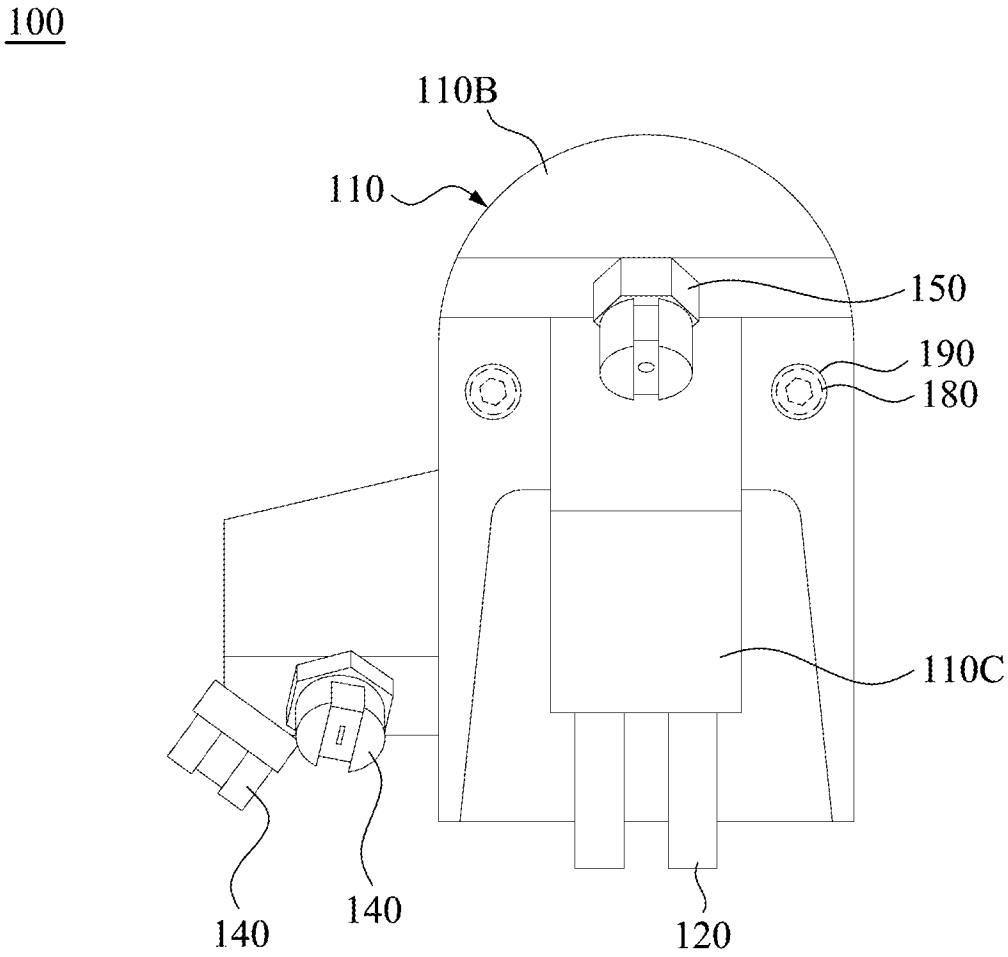
FIG. 7 is a front view of the polishing delivery apparatus illustrated in FIG. 2.

FIG. 7 is a front view of the polishing delivery apparatus 100 illustrated in FIG. 2. In some embodiments, the polishing delivery apparatus 100 further includes at least one fixing component 180 fixing the convex portion 110C to the body portion 1106 of the delivery arm 110, such that the convex portion 110C is detachably fixed to the body portion 1106 of the delivery arm 110, and the slurry delivery line 160 (see FIG. 6) and the first nozzle 120 can be removed from the delivery arm 110 for cleaning and replacement when the convex portion 110C is detached from the body portion 1106. In addition, the polishing delivery apparatus 100 further includes at least one capping component 190 tightly covering the fixing component 180. Accordingly, the slurry splashed onto the polishing delivery apparatus 100 is less likely to accumulate on an edge of the fixing component 180 and further prevents the formation of the dry residues which are deteriorated from the slurry.

According to the aforementioned embodiments of the present disclosure, since the delivery arm has the arc-shaped top surface facing away from the polishing pad, the slurry splashed onto the arc-shaped top surface of the delivery arm has a higher chance to drop back to the polishing pad during the CMP process. Therefore, the slurry is less likely to be deteriorated into dry residues which may subsequently drop back to the polishing pad to cause defect to the wafer. Furthermore, the rinse agent sprayed from the second nozzle heads facing toward the sidewalls of the recess can wash down the slurry splashed into the recess during the CMP process, thus preventing the slurry from being deteriorated into dry residues in the recess.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A polishing delivery apparatus, configured to provide slurry and rinse agent to a polishing pad, the polishing delivery apparatus comprising:

a delivery arm rotatable with respect to the polishing pad, wherein the delivery arm has an arc-shaped top surface facing away from the polishing pad, a bottom surface facing away from the arc-shaped top surface, and a recess indenting from the bottom surface;

at least one first nozzle mounted on the bottom surface of the delivery arm, wherein the first nozzle has a first nozzle head facing toward the polishing pad; and at least one second nozzle mounted in the recess of the delivery arm, wherein the second nozzle has three second nozzle heads, one of the three second nozzle heads faces toward the polishing pad, and the other two of the three second nozzle heads face toward sidewalls of the recess.

2. The polishing delivery apparatus of claim 1, wherein an angle between the second nozzle head facing toward the polishing pad and an extending plane of the polishing pad is in a range from 85° to 95°.

3. The polishing delivery apparatus of claim 1, wherein the second nozzle heads facing toward the sidewalls of the recess are tightly in contact with a top surface of the recess.

4. The polishing delivery apparatus of claim 1, wherein the second nozzle heads facing toward the sidewalls of the recess are opposite to each other.

5. The polishing delivery apparatus of claim 1, wherein a curvature radius of the arc-shaped top surface is R, a width of the delivery arm is W, and R is in a range from W/3 to 2 W/3.

6. The polishing delivery apparatus of claim 1, further comprising:

at least one slurry delivery line connected to the first nozzle; and a rinse agent delivery line connected to the second nozzle.

7. The polishing delivery apparatus of claim 6, wherein the slurry delivery line and the first nozzle are integrally formed as a single piece without an interface therebetween.

8. The polishing delivery apparatus of claim 6, wherein the slurry delivery line has a main portion and a branched portion, the main portion extends in an extending direction of the delivery arm, and the branched portion is connected to the first nozzle.

9. The polishing delivery apparatus of claim 8, wherein the rinse agent delivery line has a main portion and at least one branched portion, the main portion extends in the extending direction of the delivery arm, and the branched portion is connected to the second nozzle.

10. The polishing delivery apparatus of claim 9, further comprising a plurality of the slurry delivery lines, wherein the main portions of the slurry delivery lines are evenly distributed at two sides of the branched portion of the rinse agent delivery line.

11. The polishing delivery apparatus of claim 1, further comprising:

at least one third nozzle mounted on an edge of the delivery arm, wherein the third nozzle has a third nozzle head, and an angle between the third nozzle head and an extending plane of the polishing pad is in a range from 125° to 135°.

12. The polishing delivery apparatus of claim 11, further comprising:

at least two rinse agent delivery lines respectively connected to the first nozzle and the third nozzle, wherein the rinse agent delivery lines are coupled to each other.

13. The polishing delivery apparatus of claim 1, further comprising a fourth nozzle mounted on a front end of the delivery arm, wherein the fourth nozzle has a fourth nozzle head, and an angle between the fourth nozzle head and an extending plane of the polishing pad is in a range from 125° to 135°.

14. The polishing delivery apparatus of claim 13, wherein the fourth nozzle is mounted higher than the first nozzle and the second nozzle.

15. The polishing delivery apparatus of claim 1, wherein the delivery arm has a convex portion and a body portion, and the convex portion is detachably fixed to the body portion of the delivery arm.

16. The polishing delivery apparatus of claim 15, wherein the first nozzle is mounted on a bottom surface of the convex portion of the delivery arm.

17. The polishing delivery apparatus of claim 15, further comprising at least one fixing component fixing the convex portion to the body portion of the delivery arm.

18. The polishing delivery apparatus of claim 17, further comprising at least one capping component tightly covering the fixing component.

19. The polishing delivery apparatus of claim 1, further comprising a plurality of the second nozzles, and the second nozzles are arranged in an extending direction of the delivery arm.

20. The polishing delivery apparatus of claim 1, wherein the arc-shaped top surface of the delivery arm is made of a material comprising Teflon.

* * * * *